US006694737B2

(12) United States Patent
Tsai et al.

(10) Patent No.: US 6,694,737 B2
(45) Date of Patent: Feb. 24, 2004

(54) COMPENSATION SYSTEM FOR AN ENGINE OF A VEHICLE

(75) Inventors: Yeong-Shyeong Tsai, 5F, No. 288, Jen-Ho Rd., Taichung (TW); Shinn-Jieh Wang, Taichung (TW); Hung-Ming Tsai, Taichung (TW); Po-Yu Tsai, Taichung (TW); Lu-Hsing Tsai, Taichung (TW)

(73) Assignee: Yeong-Shyeong Tsai, Taichung (TW)

( * ) Notice: Subject to any disclaimer, the term of this patent is extended or adjusted under 35 U.S.C. 154(b) by 0 days.

(21) Appl. No.: 10/161,386

(22) Filed: May 31, 2002

(65) Prior Publication Data

US 2003/0221428 A1 Dec. 4, 2003

(51) Int. Cl.[7] ..... F02G 3/00; F02G 5/04; F01K 23/10

(52) U.S. Cl. ..... 60/616; 60/617; 60/618; 60/670

(58) Field of Search ..... 60/670, 597, 624, 60/614, 616, 610, 617

(56) References Cited

U.S. PATENT DOCUMENTS 5,176,000 A * 1/1993 Dauksis ..... 60/618
5,609,029 A * 3/1997 Ahnger et al. ..... 60/618
5,896,746 A * 4/1999 Platell ..... 60/618

FOREIGN PATENT DOCUMENTS

JP 58220945 A * 12/1983 ..... F02G/5/04

* cited by examiner

*Primary Examiner*—Sheldon J. Richter
(74) *Attorney, Agent, or Firm*—Dellett & Walters

(57) ABSTRACT

A compensation system for a vehicle has a main reservoir, a vapor collector, an expansion tube, a working liquid supplying reservoir and an oil tank. The main reservoir is connected with the vapor collector via a heat absorbing pipe. The expansion tube is connected to the vapor collector. Two turbines are rotatably received in the expansion tube and are connected to a generator. The supplying reservoir is connected to the expansion tube. The oil tank encloses the expansion tube and absorbs the heat of the waste gas dissipated from the engine. Accordingly, the turbines will be actuated to rotate by means of expansion of volume of the working liquid sprayed into the expansion tube to actuate the generator to operate. The waste heat dissipated from the engine of the vehicle can be efficiently reused.

12 Claims, 2 Drawing Sheets

COMPENSATION SYSTEM FOR AN ENGINE OF A VEHICLE

BACKGROUND OF THE INVENTION

1. Field of the Invention

The present invention relates to a compensation system, and more particularly to a compensation system for an engine of a vehicle and that can generate electrical power with the heat dissipated from the engine of the vehicle.

2. Description of Related Art

An engine provides the power of movement to a vehicle by means of the combustion of fuel. To dissipate the heat generated by the engine, a cooling system is arranged in the vehicle to reduce the temperature of the engine so as to keep the engine at an excellent performance condition.

However, the conventional cooling system in the vehicle only dissipates the heat generated by the engine to the environment, the dissipated heat is not reusable by the vehicle. In addition, the dissipated heat with high temperature will cause the rise of the environmental temperature of the Earth.

To overcome the shortcomings, the present invention tends to provide a compensation system to mitigate or obviate the aforementioned problems.

SUMMARY OF THE INVENTION

The main objective of the invention is to provide a compensation system for a vehicle and that can generate electrical power with the heat generated by the engine of the vehicle. The compensation system has a main reservoir, a vapor collector, an expansion tube, a working liquid supplying reservoir and an oil tank. The main reservoir contains working liquid and is connected with a heat absorbing pipe that is for absorbing the heat generated by the engine. The vapor collector is connected to the heat absorbing pipe to collect vapor of the working liquid. A control valve is connected to the vapor collector. The vapor collector is connected to the expansion tube with a spraying pipe. Two turbines are rotatably received in the expansion tube and are connected to a generator. The working liquid supplying reservoir is connected to the expansion tube. The oil tank contains oil and encloses the expansion tube in addition to absorb the heat of the waste gas dissipated from the engine so as to heat the expansion tube. With such a system, the turbines in the expansion tube are actuated to rotate by means of expansion of volume of the working liquid sprayed into the expansion tube, such that the generator is actuated to operate by means of the rotation of the turbines. Accordingly, the waste heat dissipated from the engine of the vehicle can be efficiently reused.

Other objects, advantages and novel features of the invention will become more apparent from the following detailed description when taken in conjunction with the accompanying drawings.

DETAILED DESCRIPTION OF PREFERRED EMBODIMENT

Figure 1:
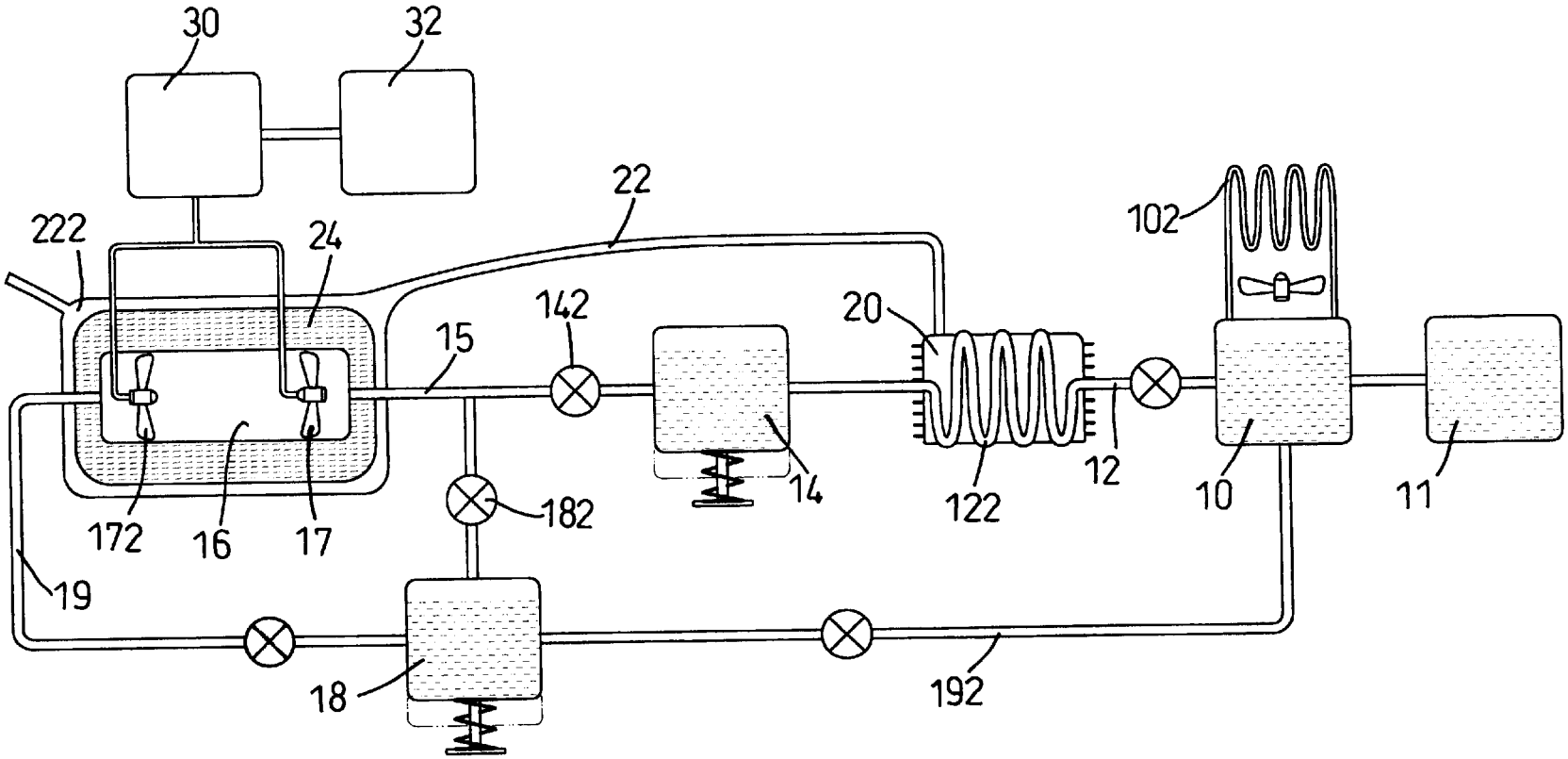
FIG. 1 is a schematic drawing of a compensation system for a vehicle in accordance with the present invention.

With reference to FIG. 1, a compensation system for an engine of a vehicle in accordance with the present invention comprises a main reservoir (10), a vapor collector (14), an expansion tube (16), a working liquid supplying reservoir (18) and an oil tank (24). The main reservoir (10) contains working liquid and is connected with a heat absorbing pipe (12). The working liquid can be water or the mixture of the water and the alcohol or the like. The heat absorbing pipe (12) has a heat absorbing section (122) arranged around the engine (20) of the vehicle, such that the heat generated by the engine (20) can be transmitted to the working liquid in the heat absorbing pipe (12) and the working liquid is vaporized. The temperature of the engine (20) can be reduced, such that the engine (20) can provide an excellent performance condition even after running for a long time.

The vapor collector (14) is connected to the heat absorbing pipe (12) to collect the vapor of the working liquid. A control valve (142) is connected to the vapor collector (14) to release the vapor of the working liquid from the vapor collector (14) when the pressure of the vapor in the collector (14) achieves a desired level. In practice, the vapor collector (14) is an expandable container, and a biasing member (not numbered) abuts the vapor collector (14). When the vapor of the working liquid is led into the collector (14), the collector (14) will be expanded. This can keep the pressure in the vapor collector (14) from exceeding the desired level and can ensure that the vapor in the heat absorbing pipe (12) can be led into the vapor collector (14) continuously. Moreover, the compressed biasing member can provide a force to the vapor collector (14) to assist the vapor to be released from the collector (14).

A spraying pipe (15) is connected to the control valve (142) on the vapor collector (14). The expansion tube (16) is connected to the spraying pipe (15). Two turbines (17,172) are rotatably received in the expansion tube (16) and are co-axially aligned with each other. The turbines (17,172) are connected to a generator (30) in common. In practice, the turbines (17,172) are co-axially attached to an axle that is connected to the generator (30). Accordingly, this can ensure that rotation direction, and rotating speed of the turbines (30) are the same as each other.

The working liquid supplying reservoir (18) is connected to the spraying pipe (15). The working liquid supplying reservoir (18) contains the working liquid the same as that in the main reservoir (10). A valve (182) is mounted on the working liquid supplying reservoir (18).

The oil tank (24) contains oil and encloses the expansion tube (16). An exhaust pipe (22) is connected to the engine (20) of the vehicle for the waste gas generated by the engine (20) being exhausted out from the exhaust pipe (22). A heating section (222) is formed on the exhaust pipe (22) to heat the oil contained in the oil tank (24). In practice, the oil tank (24) is enclosed in the heating section (222) of the exhaust pipe (22), such that the oil in the oil tank (24) can be heated with the heat of the waste gas exhausted from the exhaust pipe (20). Because the temperature of the waste gas exhausted from the engine (20) is about several hundreds ° C., the oil in the tank (24) can be heated to at least 100 to 150° C. via the heat of the waste gas. Consequently, the temperature of the expansion tube (24) can also be kept about at 100 to 150° C.

When the engine (20) of the vehicle is in operation, the heat generated by the engine (20) will be transmitted to the working liquid in the heat absorbing section (122) of the heat absorbing pipe (12) so as to vaporize the working liquid. The vapor of the working liquid will be led into and stored in the vapor collector (14). When the pressure of the vapor in the collector (14) reaches the desired level, the control valve (142) is opened and the vapor in the collector (14) is then released from the vapor collector (14). Then, the vapor is sprayed into the expansion tube (16) through the spraying pipe (15) at a high speed. At this time, the valve (182) on the working liquid supplying reservoir (18) is simultaneously opened and the working liquid in the supplying reservoir (18) will be sucked into the spraying pipe (15) to mix with the vapor of the working liquid released from the vapor collector (14). Therefore, the working liquid will be atomized and sprayed into the expansion tube (16) at a high speed. When the working liquid enters the expansion tube (16), the first turbine (17) will rotate due to the impact of the working liquid moving at a high speed. Because the temperature of the expansion tube (16) is heated to a high temperature level, the atomized working liquid will be immediately vaporized. Due to the change of the phase of the working liquid, the volume of the working liquid will be quickly expanded. The second turbine (172) will be force to rotate by means of the expansion of the working liquid. The generator (30) is actuated to generate electricity by means of the rotations of the turbines (17,172), and the electricity generated by the generator (30) can be stored in a storage battery (32). In practice, the electricity can be applied to the electrical devices in the vehicle. Either, when the electricity is stored in the battery (32) to a desired large amount, the engine (20) of the vehicle can be switched off and an electrical actuating device can be switched on to take place of the engine (20). Consequently, the vehicle can be transformed to an electrical vehicle and the fuel source is changed from gasoline to electricity such that the consumption and requirement of the fuel are reduced.

With such a system, because the energy for generating the electricity comes from the heat dissipated from the engine (20), the energy by burning the fuel can be further efficiently reused. In addition, because the heat dissipated from the engine (20) is used to generate electrical power, the heat dissipated to the environment is reduced and the Earth's global warming can be slowed.

When the pressure of the vapor in the vapor collector (14) reduces to a low level, the control valve (142) and the valve (18) are closed. The control valve (142) and the valve (18) will be opened again, when the vapor pressure in the vapor collector (14) achieves the desired level.

In addition, an outlet pipe (19) is connected between the expansion tube (16) and the working liquid supplying reservoir (18). With the outlet pipe (19), the working liquid exhausted from the expansion tube (16) can be led into the working liquid supplying reservoir (18) and to the working liquid in the reservoir (18). The vapor of the working liquid entering the reservoir (18) will be cooled by the working liquid in the reservoir (18) and will immediately condense to liquid to supplement the loss of the working liquid in the supplying reservoir (18). In practice, the working liquid supplying reservoir (18) is an expandable container, and a biasing member (not numbered) abuts the supplying reservoir (18). When the working liquid is led into the supplying reservoir (18), the reservoir (18) is expanded to avoid the pressure in the reservoir (18) from being over the desired level. This can ensure that the working liquid released from the expansion tube (16) can be led into the supplying reservoir (18) continuously.

Furthermore, a connecting pipe (192) is connected between the main reservoir (10) and the working liquid supplying reservoir (18), such that the liquid level and the temperature of the working liquid supplying reservoir (18) can be kept to be same to those in the main reservoir (10). A heat dissipating pipe (102) is mounted on the main reservoir (10) to dissipate the heat in the working liquid in the main reservoir (10). Consequently, the temperature of the working liquid in the main reservoir (10) and the supplying reservoir (18) is reduced. An auxiliary reservoir (11) containing working liquid is connected to the main reservoir (10) to supplement the working liquid to the main reservoir (10).

Figure 2:
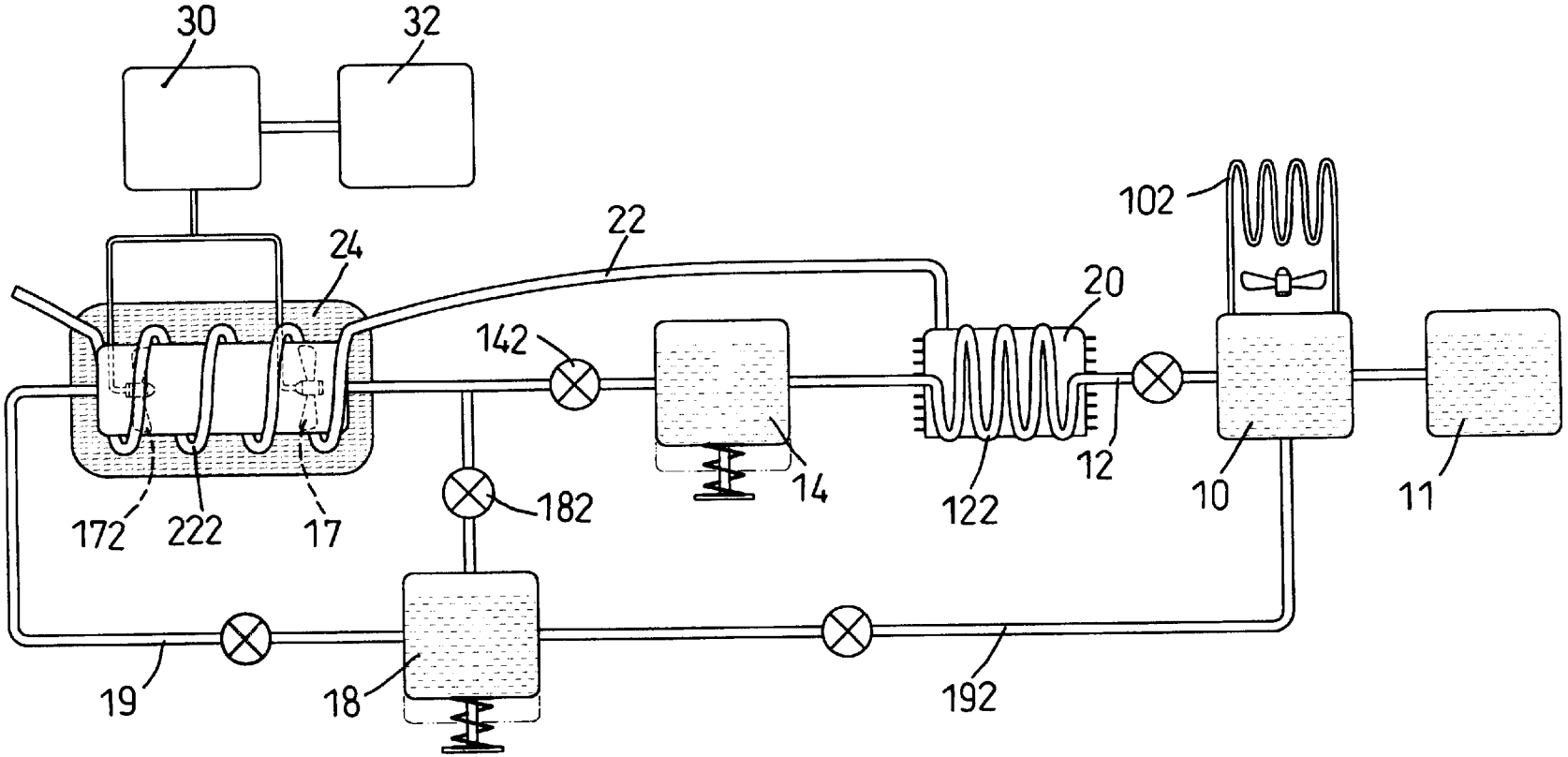
FIG. 2 is a schematic drawing of another embodiment of a compensation system for a vehicle in accordance with the present invention.

With reference to FIG. 2, the heating section (222) of the exhaust pipe (20) extends into the oil tank (24) and surrounds the expansion tube (16). Accordingly, the heat of the waste gas dissipated from the engine (20) can be efficiently transmitted to the oil in the oil tank (24).

In another embodiment, there are multiple expansion tubes (16) connected with each other in series and a working liquid supplying reservoir (18) connected to each respective expansion tubes (16). Each expansion tube (16) has two turbines (17,172) rotatably received in the expansion tube (16), and the turbines (17,172) in the expansion tubes (16) are all co-axially connected to an axle. The axle is connected to the generator (30), and a clutch is mounted on the axle and is kept unlocked at the initial position.

When the vapor in the collector (14) is released and the working liquid in the first supplying reservoir is sucked and sprayed into the first expansion tube (16), the turbines (17,172) in the first expansion tube (16) will be rotated by means of the expansion of the volume of the working liquid. Because the turbines (17,172) of all of the expansion tubes (16) are connected to an axle in common, all of the turbines (17,172) will rotate at the same speed. In addition, because the clutch is at an unlocked condition, the load bearing of the turbines (17,172) is low so as to ensure the rotations of the turbines (17,172). When the vapor of the working liquid is released from the first expansion tube (16), the vapor of the working liquid will be sprayed into the second expansion tube (16). The working liquid in the second supplying reservoir (18) will be sucked and sprayed into the second expansion tube (16), such that the turbines (17,172) in the second expansion tube (16) will be rotated by the expansion of the working liquid. Consequently, the rotating speed of the turbines will increase. When the rotating speed of the turbines (17,172) reaches a desired high level, the clutch is switched to a locked condition. Accordingly, the generator (30) is actuated to generate the electrical power by means of the rotations of the turbines (17,172).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A compensation system for an engine of a vehicle comprising:

a main reservoir containing working liquid;

a heat absorbing pipe connected to the main reservoir and adapted to absorb heat generated by the engine so as to vaporize the working liquid in the heat absorbing pipe;

a vapor collector connected to the heat absorbing pipe to collect vapor of the working liquid and having a control valve connected to the vapor collector;

at least one expansion tube connected to the control valve on the vapor collector and each one of the at least one expansion tubes having two turbines rotatably received in the expansion tube, the turbines co-axially aligning with each other and adapted to be connected to a generator;

a working liquid supplying reservoir containing working liquid and connected to each respective at least one expansion tube; and an oil tank containing oil, enclosing the at least one expansion tube and adapted to absorb heat of waste gas discharged from the engine to heat the expansion tube, whereby the turbines in the at least one expansion tube are rotated by means of expansion of volume of the working liquid sprayed into the at least one expansion tube; and the generator is actuated to operate by means of the rotation of the turbines.

2. The compensation system as claimed in claim 1 further comprising an outlet pipe connected between the expansion tube and the working liquid supplying reservoir.

3. The compensation system as claimed in claim 1 further comprising a spraying pipe connected between the control valve on the vapor collector and the at least one expansion tube.

4. The compensation system as claimed in claim 1, wherein the heat absorbing pipe has a heat absorbing section adapted to be arranged around the engine of the vehicle to absorb the heat generated by the engine.

5. The compensation system as claimed in claim 1 further comprising a connecting pipe connected between the main reservoir and the working liquid supplying reservoir.

6. The compensation system as claimed in claim 1 further comprising a dissipating pipe mounted on the main reservoir to dissipate the heat in the working liquid in the main reservoir.

7. The compensation system as claimed in claim 1 further comprising an auxiliary reservoir containing working liquid connected to the main reservoir to supplement the working liquid to the main reservoir.

8. The compensation system as claimed in claim 1, wherein the turbines in the at least one expansion tube are co-axially attached to an axle that is adapted to be connected to the generator.

9. The compensation system as claimed in claim 1, further comprising a clutch mounted on the axle.

10. The compensation system as claimed in claim 1 further comprising an exhaust pipe adapted to be connected to the engine of the vehicle to exhaust the waste gas discharged from the engine, wherein the exhaust pipe has a heating section to heat the oil contained in the oil tank to a desired temperature by indirect exposure of the oil to the heat or the waste gas.

11. The compensation system as claimed in claim 10, wherein the oil tank is enclosed in the heating section of the exhaust pipe.

12. The compensation system as claimed in claim 10, wherein the heating section of the exhaust pipe extends into the oil tank and surrounds the expansion tube.

* * * * *